US006173475B1

(12) United States Patent
Senn et al.

(10) Patent No.: US 6,173,475 B1
(45) Date of Patent: Jan. 16, 2001

(54) HINGE ASSEMBLY

(75) Inventors: Brian A. Senn, South Milwaukee; Robert S. Toms, Jr., Racine, both of WI (US); Ronald W. Kerr, Geneva, IL (US)

(73) Assignee: Powerbrace Corporation, Kenosha, WI (US)

( * ) Notice: Under 35 U.S.C. 154(b), the term of this patent shall be extended for 0 days.

(21) Appl. No.: 09/255,157

(22) Filed: Feb. 22, 1999

(51) Int. Cl.[7] ..... E05D 11/00

(52) U.S. Cl. ..... 16/273; 16/389; 16/385; 16/DIG. 27

(58) Field of Search ..... 16/273, 389, DIG. 27, 16/275, 385, 386, 387

(56) References Cited

U.S. PATENT DOCUMENTS

| | | | | |
|---|---|---|---|---|
| 2,624,067 | * | 1/1953 | Tassell | 16/389 |
| 3,599,275 | * | 8/1971 | Granzow | 16/275 |
| 3,921,225 | * | 11/1975 | Suska | 16/273 |
| 4,353,146 | * | 10/1982 | Brockhaus | 16/385 |
| 4,475,266 | * | 10/1984 | Suska | 16/273 |
| 4,573,239 | * | 3/1986 | Valenti et al. | 16/273 |
| 4,675,940 | * | 6/1987 | Brockhaus | 16/273 |
| 5,463,795 | * | 11/1995 | Carlson et al. | 16/273 |

FOREIGN PATENT DOCUMENTS

| | | | | |
|---|---|---|---|---|
| 3401245 | * | 7/1985 | (DE) | 16/273 |
| 552409 | * | 4/1943 | (GB) | 16/389 |
| 1330499 | * | 9/1973 | (GB) | 16/273 |
| 2047327 | * | 11/1980 | (GB) | 16/273 |

* cited by examiner

*Primary Examiner*—Chuck Y. Mah
(74) *Attorney, Agent, or Firm*—John W. Harbst

(57) ABSTRACT

A hinge assembly for pivotally interconnecting a door to a trailer body is disclosed. The hinge assembly includes a hinge plate having a mounting portion and a hinge portion. The mounting portion of the hinge plate is configured to permit attachment to the door, while the hinge portion of the hinge plate defines an elongated closed passage opening at opposite ends thereof. Bearing structure is non-rotatably accommodated within the passage for forming a bearing connection between the hinge plate and a pivot member endwise extending through the hinge portion of the hinge plate. The bearing structure includes a cap formed integral therewith and extending from opposite ends of the passage.

25 Claims, 4 Drawing Sheets

FIG. 2
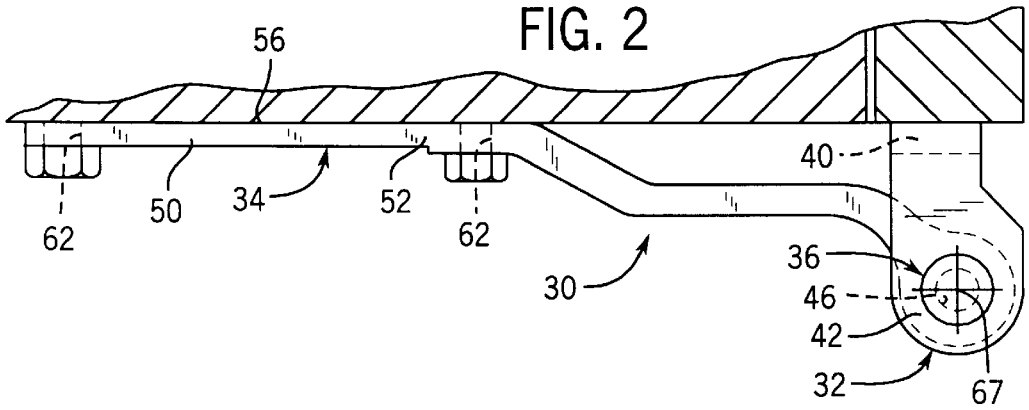
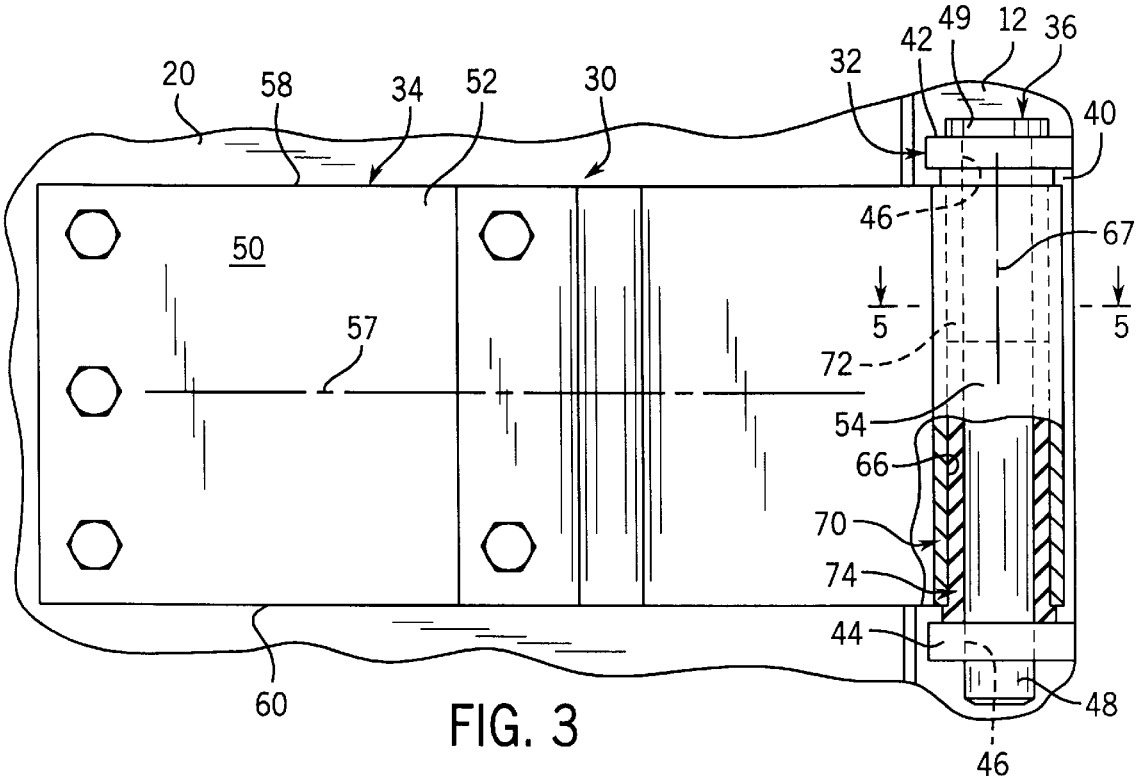
FIG. 3

HINGE ASSEMBLY

FIELD OF THE INVENTION

The present invention generally relates to hinges and, more particularly, to an economical hinge assembly including an aluminum hinge plate provided with bearing structure which moves with the hinge plate and journals a pivot member to enhance performance of the hinge assembly.

BACKGROUND OF THE INVENTION

Trailer bodies are typically provided with a pair of side-by-side swing doors for closing an open end of the trailer body. Each swing door is pivotally interconnected to the trailer body by a plurality of vertically spaced hinges. Each hinge is configured to permit the swing door to move through an arc of about 270°. The door to which the hinge is connected is typically formed from wood with steel or aluminum sheeting covering the inner and outer sides or surfaces thereof As is well known, a series of attachment members, i.e., threaded bolts and nuts, are used to secure each hinge to a swing door. Because they are secured outside the trailer body and door, the hinges are exposed to all environmental conditions such as rain, sleet, snow as well as road salts, greases, dust, dirt and related debris which is thrown rearwardly as the trailer body moves over the road. Manufacturing costs and exposure to such environmental conditions has led many manufacturers to form the hinge assembly from aluminum. Besides its ability to withstand rust and corrosion, aluminum hinges are lightweight and yet offer significant strength.

A typical hinge assembly includes an elongated hinge plate having a mounting portion and a hinge portion. The mounting portion has a generally flat configuration and, as mentioned, is typically secured to the swing door of the trailer body. The hinge portion of the hinge plate typically fits between vertically spaced and axially aligned apertured projections of a hinge butt. Moreover, the hinge portion of the hinge plate defines an elongated passage or opening for accommodating a steel pivot member. As will be appreciated, the steel pivot member passes endwise through an aperture defined by the upper projection of the hinge butt, downwardly through the elongated passage defined by the hinge portion of the hinge plate, and, ultimately, through the aperture on the lower projection of the hinge butt. During swinging movements of the door, the inner diameter or margin of the elongated passage defined by the hinge portion of the hinge plate rotates on the steel pivot member. Steel or nylon washers are commonly provided between upper and lower surfaces of the hinge portion of the hinge plate and the projections on the hinge butt. These washers are free to rotate relative to the pivot member and to the hinge plate.

Although generally beneficial to hinge performance, using washers in combination with the hinges presents certain problems. Such problems are furthermore exacerbated when the hinge plate is formed from aluminum. Many times the washers catch on or are frozen to the hinge butt, and remain stationary with the hinge butt as the door swings between open and closed positions. In such an instance, during rotation of the hinge, the ends of the hinge portion of the hinge plate rub against the washers. Whether the washer is made from steel or nylon, the softer aluminum on the hinge plate wears. As will be appreciated by those skilled in the art, wearing of the hinge portion of the hinge plate can result in the door sagging and, thus, presenting a myriad of additional problems.

The use of washers in combination with the hinge furthermore complicates the installation process. During installation, the pivot member must pass through the hole or aperture in one end of the hinge butt, through a washer, through the elongated opening in the hinge portion of the hinge plate, through a second washer, and, ultimately through the other hole or aperture at the opposite end of the hinge butt. As will be appreciated, difficulties arise in lining up all the holes while maintaining the relatively small washers in place as the pivot member is being inserted through the various components of the hinge assembly.

In some aluminum hinges, bearings are press fit into the elongated passage defined by the hinge plate. As will be appreciated by those skilled in the art, such bearings must be press fit into the hinge plate or the tolerances between the parts would result in an unacceptable product. In such heretofore known aluminum hinges, and because of the press fit established between the bearings and the hinge plate, it is substantially impossible to replace the bearings when they wear. Instead, the entire hinge plate with the bearings pressed thereinto must be replaced. In addition to the cost of the bearings, providing such bearings in combination with the hinge plate involves a labor intensive operation along with appropriate tooling costs, thus, leading to a relatively expensive hinge assembly. Of course, the cost of each hinge assembly is multiplied by the number of hinges used to interconnect the door to the trailer body.

Thus, there is a continuing need and desire for a hinge assembly utilizing an economic aluminum hinge plate provided with bearings to enhance the wearability of the hinge assembly over an extended period of time.

SUMMARY OF THE INVENTION

In view of the above, and in accordance with the present invention, there is provided a hinge assembly for connecting a door to trailer body in a manner permitting pivotal movements of the door about a generally vertical axis. The hinge assembly includes a hinge plate having a mounting portion and a hinge portion. The mounting portion of the hinge plate is configured to permit attachment to the door. The hinge portion of the hinge plate defines an elongated passage open at opposite ends thereof The hinge assembly of the present invention furthermore includes bearing structure non-rotatably accommodated within the elongated passage in the hinge plate. The bearing structure is provided to form a bearing connection between the hinge plate and a pivot member endwise extending through the hinge portion of the hinge plate. At opposite ends thereof, the bearing structure is provided with a cap formed as an integral part of the bearing structure and extending from opposite ends of the passage defined by the hinge portion of the hinge plate.

In a preferred form of the invention, the hinge plate of the hinge assembly is formed from aluminum. Moreover, in a preferred form of the invention, the mounting portion of the hinge plate has a generally planar configuration and defines a series of apertures or holes for allowing attachment members, such as threaded fasteners, to pass endwise therethrough. In a most preferred form of the invention, and to facilitate swinging movements of the door to which the hinge assembly is attached through an arcuate path of 270°, the mounting portion and hinge portion of the hinge plate are offset relative to each other. That is, the mounting portion and the hinge portion of the hinge plate are offset in generally parallel planes relative to each other and are joined to each other through an angled neck portion In a preferred form of the invention, the bearing structure includes a pair of bearings inserted from opposite ends into the passage defined by the hinge portion of the hinge plate. Each bearing defines an elongated opening which journals the steel pivot member and a cap as an integral part thereof for limiting axial insertion of the bearing into the passage. In a most preferred form of the invention, the bearing structure is formed from an elastomeric material to enhance the wearability of the bearings.

As mentioned above, the bearing structure is non-rotatably accommodated within the hinge portion of hinge plate. Preferably, a positive locking relationship is established between the bearing structure and the hinge plate of the hinge assembly. In a preferred form of the invention, the hinge plate defines a keyway as part of the elongated passage defined in the hinge portion of the hinge plate. In a most preferred form of the invention, the keyway extends into the neck portion of the hinge plate thereby avoiding weakening of the hinge plate. The keyway is sized and configured to snugly accommodate a key forming part of each one-piece bearing thereby preventing rotation of each bearing relative to the hinge plate.

The key and keyway can take different shapes without detracting or departing from the spirit and scope of the present invention. The keyway preferably has a generally linear configuration between opposed ends thereof In one form, the key forming part of each bearing has a resilient curved configuration between opposed ends thereof for inhibiting inadvertent endwise movement of the bearing relative to the hinge plate. Alternatively, the key can have a resilient flanged configuration which snugly fits within the keyway to inhibit inadvertent shifting movements of the bearing relative to the hinge plate.

Providing a non-rotatably accommodated bearing structure within the elongated passage defined by the hinge portion of an aluminum hinge plate offers several distinct advantages over the prior art. The bearing structure forms a bearing connection between the hinge plate and the pivot member thereby substantially eliminating wear on the inner diameter of the elongated passage, defined by the hinge portion of the aluminum hinge plate thereby inhibiting sagging movements of the doors mounted by such hinge assemblies. Additionally, and since the bearing structure is non-rotatably mounted to the hinge plate, there is no relative movement therebetween. Thus, the detrimental effects contaminants naturally have between the bearing structure and the aluminum hinge plate are eliminated. Moreover, and because the caps at opposed ends of the bearing structure rotate with the hinge plate, the natural wear normally persistent between washers and the aluminum hinge plate are advantageously eliminated. Furthermore, the caps provided at opposite ends of the hinge portion of the hinge plate protect the hinge portion of the hinge plate against undue wear. With the present invention, relative movement is limited to between the bearing structure, pivot member, and hinge butt. Of course, the pivot member and bearing structure are both easily and readily replaceable parts of the hinge assembly.

In a preferred form of the invention, the bearing structure is snugly accommodated within the hinge portion of the hinge assembly. In a most preferred form of the invention, the bearings comprising the bearing structure are axially inserted within the elongated passage defined by the hinge portion from opposite ends thereof The snug or slight interference fit between the bearings and the hinge plate allow the bearings to be readily and easily replaced and yet they will not freely fall from the passage. This design, of course, advantageously benefits assembly of the hinge structure.

Because the bearings of the bearing structure can be preassembled to the hinge plate in the elongated passage defined by the hinge portion of the hinge plate, inserting the pivot member to attach the hinge plate to the hinge butt is facilitated. The present invention lessens alignment problems when inserting the pivot member through the hinge butt and hinge plate. That is, with the present invention, there are now only three holes—rather than five as compared to when washers are utilized—to align. The three holes to be aligned with the present invention involve the hole at one end of the hinge butt, the opening defined by the bearing structure, and the hole in the opposite end of the hinge butt. Moreover, because the bearing structure is preassembled to the hinge plate, there are only three parts to assemble when the hinge structure is mounted to the trailer body. They are, the hinge butt, the hinge plate with bearing structure assembled therewithin, and the pivot member.

In view of the above, a primary object of the present invention is to provide an aluminum hinge assembly for allowing a trailer door to be moved through an arc of about 270° and which includes bearing structure for forming a bearing connection between and thereby reducing wear between the hinge assembly and the pivot member passing endwise therethrough.

Another object of the present invention relates to the provision of a hinge structure which allows easier assembly and repair than heretofore known hinge assemblies.

Still another object of the present invention is to allow an economical aluminum hinge structure to be used in combination with trailer bodies to yield advantageous results against normal road contaminants and rust and yet which is designed for prolonged use.

These and other objects, aims and advantages of the present invention will become more readily appreciated and apparent from the following detailed description, drawings and the appended claims.

DETAILED DESCRIPTION OF THE DRAWINGS

FIG. 2 is an enlarged top plan view of the hinge assembly of the present invention connected to a swing door of the trailer body;

FIG. 3 is an enlarged end view of the hinge assembly illustrated in FIG. 2;

DETAILED DESCRIPTION OF THE PRESENT INVENTION

Figure 1:
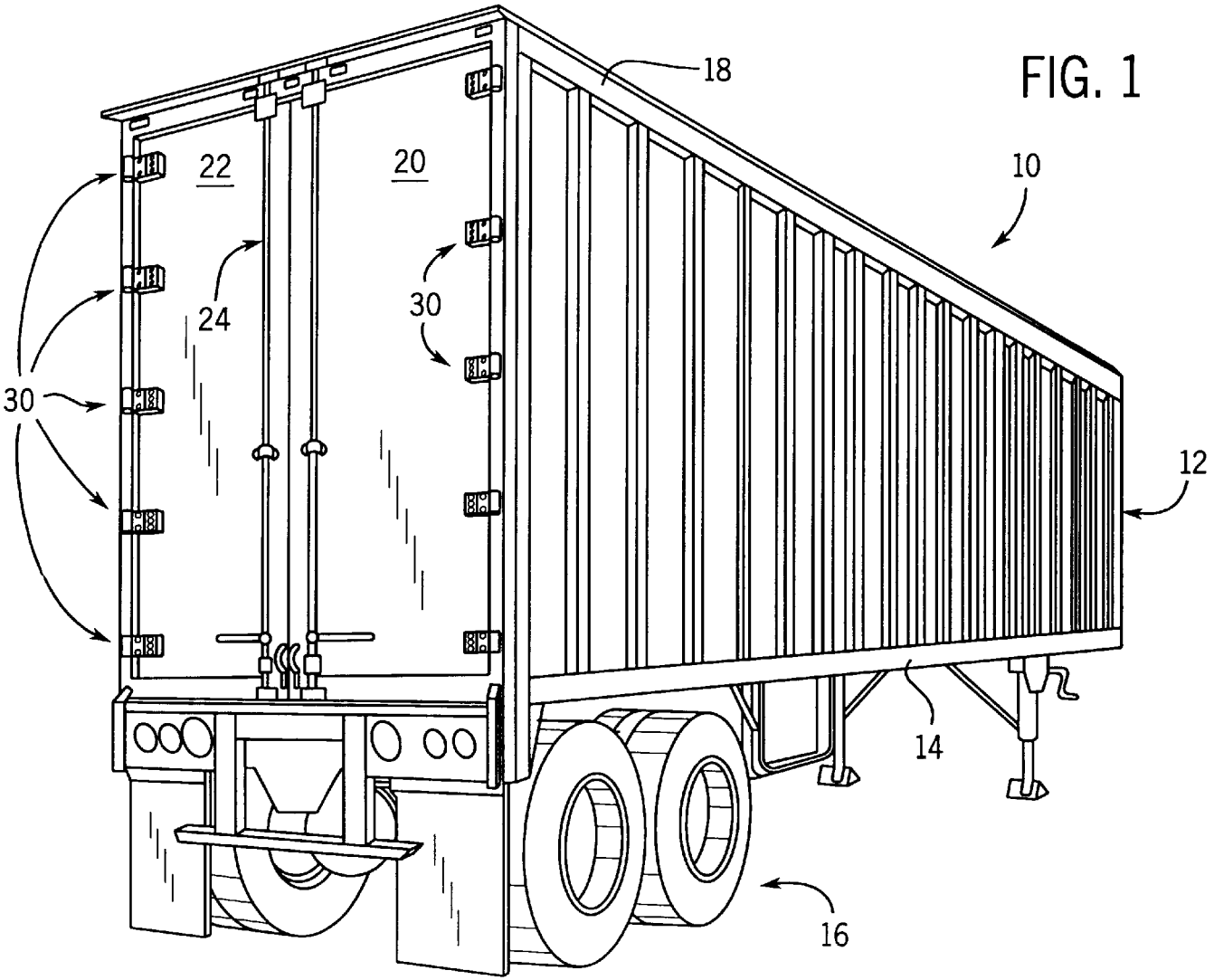
FIG. 1 is a rear perspective view of a trailer body having swing doors connected to an open end thereof with hinge assemblies according to the present invention.

While the present invention is susceptible of embodiment in various forms, there is shown in the drawings and will hereinafter be described in detail preferred embodiments of the invention with the understanding the present disclosure is intended to set forth examples of the invention which are not intended to limit the invention to the specific embodiments illustrated.

Referring now to the drawings, wherein like reference numerals refer to like parts throughout the several views, in FIG. 1 a schematic illustration of a substantially conventional trailer, generally indicated by reference numeral 10, is shown. In the exemplified embodiment, trailer 10 includes an elongated trailer body or enclosure 12 having a rectangularly walled configuration including a floor (not shown). As is well known in the art, the trailer body 12 includes a rigid frame 14 supported for movement over the ground by one or more pairs of ground engaging wheels 16.

As is conventional, the trailer body 12 defines an open rear end 18 for allowing transportable commodities to be loaded into the walled enclosure or body 12. In the illustrated trailer body 12, the open rear end 18 is closed by a pair of substantially identical swing doors 20, 22. Each swing door 20, 22 is preferably fabricated with a wood core (not shown) and conventional metal sheeting extending over the interior and exterior surfaces or sides thereof. Suitable hardware 24 is provided on the doors 20, 22 and trailer body 12 to releasably lock the doors 20, 22 in a closed position. Toward an outer vertical edge thereof, each door 20, 22 is provided with a plurality or series of virtually identical hinge assemblies or hinge structures 30.

The hinge assemblies 30 serve to interconnect each door 20, 22 to the trailer body 12 while allowing each door 20, 22 to swing through an arc of about 270°. After the doors 20, 22 are swung through an arc of about 270° from the position illustrated in FIG. 1, each door 20, 22 will extend generally parallel to and along side a respective side wall of the trailer body 12. The trailer body 12 is typically provided with conventional hardware (not shown) for latching or otherwise releasably securing the doors 20, 22 to the sides of the trailer body 12.

FIGS. 2 and 3 illustrate, in more detail, specifics of a hinge structure 30 according to the present invention. As shown, each hinge structure 30 includes a hinge butt 32 and a hinge plate 34 articulately or pivotally interconnected to the hinge butt 32 through an elongated steel pivot member 36. The hinge butt 32 is typically formed from steel and is secured to the trailer body 12 preferably as through welding or, in the alternative, through suitable threaded fasteners. As illustrated, the hinge butt 32 includes a vertically elongated body or base 40 with a pair of vertically spaced or separated ears 42, 44 projecting outwardly from the base 40. Each ear or projection 42, 44 defines an aperture 46 for accommodating endwise passage of lengthwise portions of the pivot member 36 therethrough.

Figure 4:
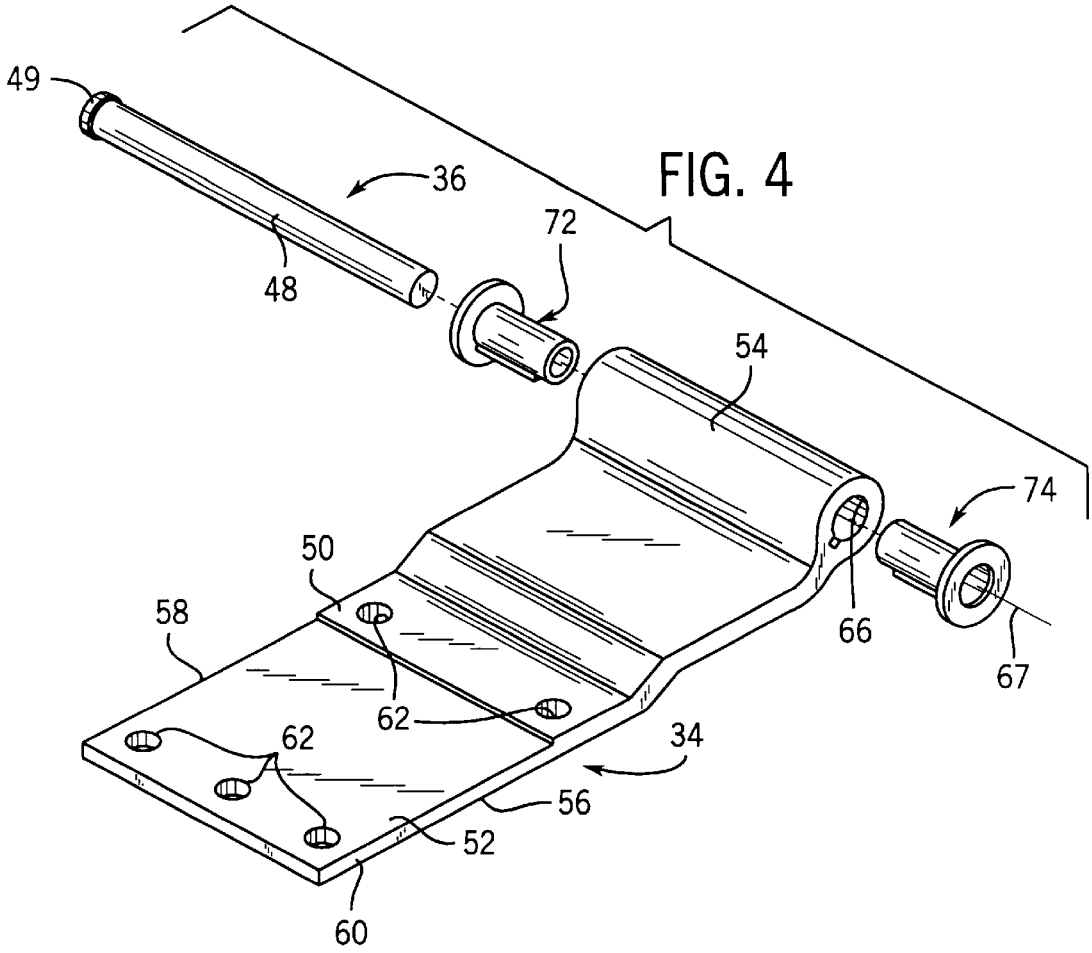
FIG. 4 is a perspective view of various components of the hinge assembly of the present invention illustrated in separated relation relative to each other.

The pivot member 36 can be of any suitable and preferably conventional design. For example, the pivot member 36 can be in the form of either an elongated pivot pin or elongated bolt. When a pin design is used, and as illustrated in FIG. 4, the pivot pin 36 includes an elongated generally cylindrical pin portion 48 with an enlarged head or cap 49 at one end thereof. As will be appreciated, the cylindrical pin portion 48 of pivot pin 36 is sized to extend endwise through the apertures 46 in the separated supports or projections 42 and 44 of the hinge butt 32 while the head or cap portion 49 limits axial insertion of the pivot pin 36 relative to the hinge butt 32.

The hinge plate 34 of each hinge assembly includes a longitudinally elongated preferably one-piece body 50 comprised of a mounting portion 52 and a hinge portion 54 extending along one edge of the body 50. The hinge body 50 is preferably formed from an aluminum material or aluminum alloy. It should be appreciated, however, the hinge body 50 can be formed from other materials without detracting or departing from the spirit and scope of the present invention.

The mounting portion 52 of the hinge body 50 defines a generally flat mounting surface 56 extending across and between opposed edges 58 and 60 defining the width of the hinge body 50. When the hinge assembly 30 is secured to a door 20, 22, the flat mounting surface 56 is arranged in confronting or abutting relation relative to an exterior surface on the door 20, 22. In a preferred form of the invention, the mounting portion 52 of the hinge body 50 further defines a series of through holes or bores 62 (FIG. 4) for allowing suitable fasteners, i.e., threaded bolts or the like, to pass endwise through the mounting portion 52 thereby securing the hinge plate 34 to the door 20, 22.

Figure 5:
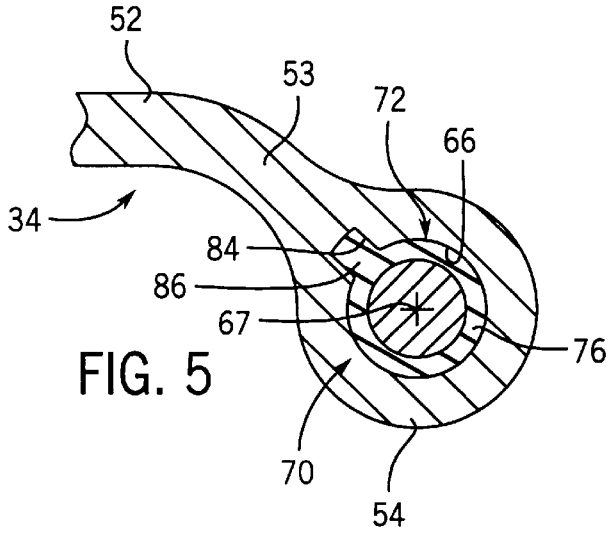
FIG. 5 is an enlarged sectional view taken along line 5—5 of FIG. 3.

In the exemplified embodiment, and as illustrated in FIG. 2, the mounting portion 52 and hinge portion 54 of the hinge plate 34 are preferably arranged in generally offset relation relative to each other. That is, the mounting portion 52 and hinge portion 54 of the hinge plate 34 are offset in generally parallel planes relative to each other. As shown in FIG. 5, an angularly disposed neck portion 53 serves to interconnect and maintain the mounting portion 52 and hinge portion 54 in offset relation relative to each other without detracting from the strength or rigidity of the hinge plate 34.

The hinge portion 54 of the hinge plate 34 defines an elongated passage or opening 66 preferably having a closed margin and defining an elongated axis 67 disposed generally perpendicular or normal to an elongated axis 57 defined by the mounting portion of body 50. The elongated passage 66 opens at opposite ends thereof. In the illustrated form of the invention, the elongated passage or opening 66 has a relatively constant diameter along the length thereof.

The hinge assembly 30 of the present invention furthermore includes bearing structure 70 non-rotatably accommodated within the passage 66 defined by the hinge portion 54 of the hinge plate 34 for forming a bearing connection between the hinge plate 34 and the pivot member 36. In the illustrated form of the invention, as shown in FIGS. 3 and 4, bearing structure 70 includes a pair of axially aligned bearings 72 and 74 accommodated within the passage 66 of the hinge portion of the hinge plate 66.

Figure 6:
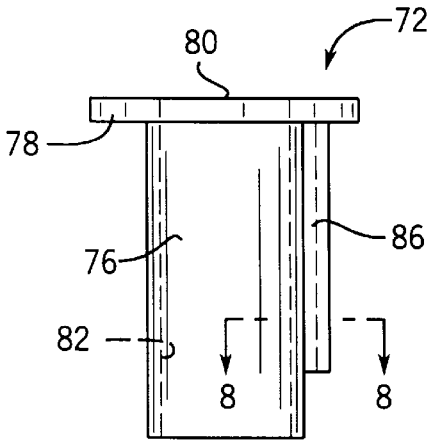
FIG. 6 is an elevational view of one form of bearing structure forming part of the present invention.
Figure 7:
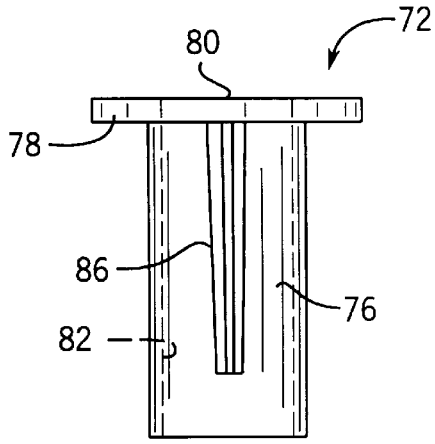
FIG. 7 is another elevational view of the bearing structure illustrated in FIG. 6.

In the preferred form of the invention, the bearings 72 and 74 are substantially identical relative to each other. Accordingly, only bearing 72 will be discussed in detail. Each bearing 72, 74 is formed from a non-metallic preferably elastomeric material such as nylon or the like. As illustrated in FIGS. 6 and 7, each bearing 72, 74 includes an elongated generally cylindrical or barrel-like portion 76 having an outside diameter generally equal to the diameter of the passage 66 defined in the hinge portion 54 of the hinge plate 34. Each bearing 72, 74 furthermore includes a cap portion 78 which is shaped to limit axial insertion of the bearings 72, 74 into the elongated opening or passage 66. Preferably, the cap portion 78 of each bearing 72, 74 defines a bearing surface 80 at a free end thereof extending from the passage 66 defined by the hinge portion 54 of the hinge plate 34. As illustrated, each bearing 72, 74 furthermore defines a bore 82 open at opposite ends. The bore 82 is sized to journal lengthwise sections of the pin portion 48 of pivot pin 36 passing endwise therethrough.

Preferably, the barrel-like portion 76 and cap portion 78 of each bearing 72, 74 are integrally formed relative to each other. Moreover, and as should be appreciated, the cap portion 78 can be configured other than that shown without departing or detracting from the spirit and scope of the present invention.

As mentioned above, the bearing structure 70 is non-rotatably accommodated within the passage 66 defined by the hinge portion 54 of the hinge plate 34. In the exemplary embodiment of the invention, a positive locking relationship is established between the bearing structure 70 and the passage or opening 66 defined by the hinge portion 54 of hinge plate 34. In the preferred form of the invention, and as illustrated in FIG. 5, the passage 66 defined by the hinge plate 34 is provided with an elongated generally linear keyway 84 extending the length of the passage 66 and open at opposite ends thereof. To avoid weakening the hinge plate 34, and as illustrated in FIG. 5, the keyway 84 is preferably oriented or extends radially outwardly from the passage 66 in the direction of the neck portion 53 of the hinge plate 34.

Returning to FIGS. 6 and 7, each bearing 70, 72 is preferably provided with a suitably shaped key 86 which snugly fits within the keyway 84 thereby inhibiting rotation of the bearing 72, 74 relative to the hinge plate. The key 86 extends radially outwardly from and for a lengthwise distance along the barrel-like portion 76 of each bearing 72, 74.

Figure 8:
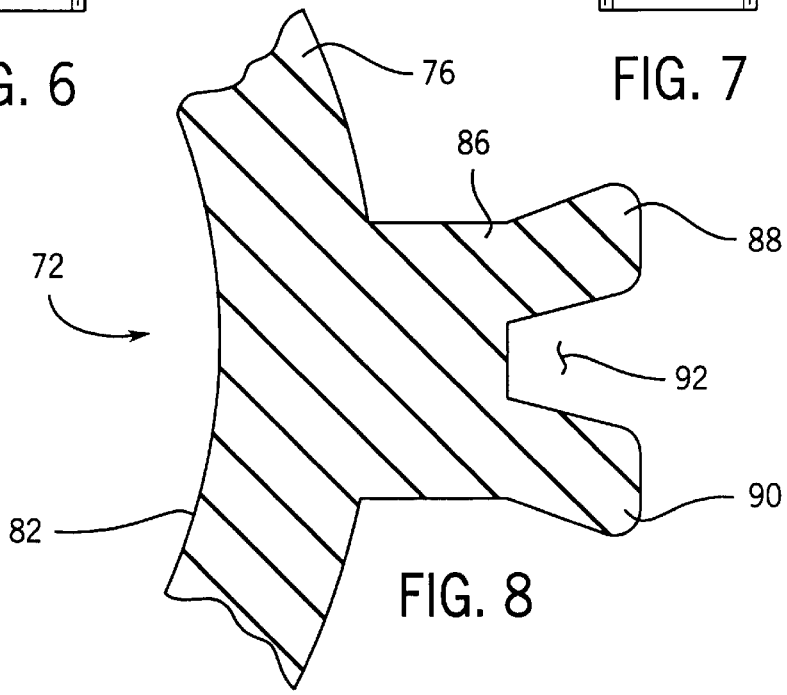
FIG. 8 is an enlarged sectional view taken along line 8—8 of FIG. 6.

In the embodiment illustrated in FIGS. 6, 7 and 8, key 86 has a split or flanged configuration extending along the length thereof. That is, a free radial end of the key 86 has a pair of adjacent ears 88 and 90 with an elongated slit or space 92 therebetween. The ears 88 and 90 diverge away from each other but are resiliently formed such that when an adequate force is placed thereon, they will be forced together. As will be appreciated, when the key 86 is introduced into the keyway 84, side edges of the keyway 84 force the ears 88 and 90 toward each other to establish a relatively tight fit between the key 86 and the keyway 84 thus inhibiting inadvertent shifting movements of the bearings 72, 74 relative to the passage 66 defined by the hinge portion 54 of the hinge plate 34. As will be appreciated, the resiliency of the ears 88 and 90 pressing against the sides of the keyway 84 furthermore enhance maintenance of the relationship between each bearing 72, 74 and the opening or passage 66 in the hinge plate 34.

Figure 9:
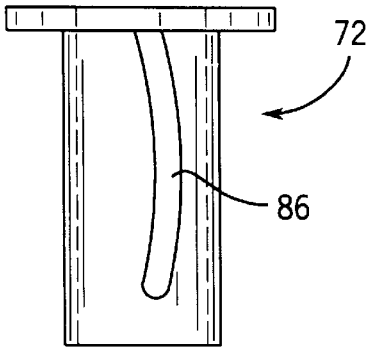
FIG. 9 is an elevational view of an alternative form of bearing structure forming part of the present invention.
Figure 10:
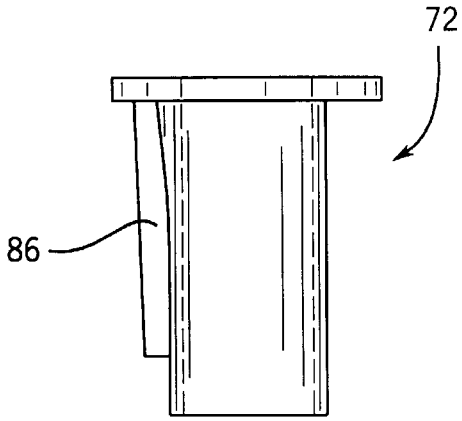
FIG. 10 is another elevational view of the alternative bearing structure illustrated in FIG. 9.

As will be appreciated by those skilled in the art, the key 86 can take different forms and shapes without detracting or departing from the spirit and scope of the present invention. For example, and as illustrated in FIGS. 9 and 10, the key 86 can be provided with a generally curved configuration between opposed vertical ends thereof With the bearings 72, 74 and therefor the keys 86 being formed from an elastomeric material, the resiliency of the key 86 allows a certain deflection of the curved configuration thereof to slidably fit within the linear keyway 84 while inhibiting shifting or axial movements of the bearings 72, 74 within the passage 66 defined by the hinge plate 34. Of course, the tendency of the key 86 to maintain its curved configuration provides continuous resilient forces on opposed sides of the linear keyway 84 in a manner inhibiting shifting movements of the bearings 72, 74 within the passage 66 defined by the hinge plate 34.

In operation, the hinge structures 30 used to interconnect the doors 20, 22 to the trailer body 12 not only allow the doors 20, 22 to move through a 270° path of movement to allow them to be moved from a closed position (FIG. 1) to a position whereat they are secured to the sides of the trailer body, but forming the hinge assemblies 30 with an aluminum hinge plate 34 is furthermore economical to manufacture while resisting corrosion from road contaminants and rust. Providing the non-rotatably accommodated bearing structure 70 within the elongated passage 66 defined by the hinge plate 34 furthermore yields several advantages over heretofore known aluminum hinges. As mentioned above, the bearing structure 70 provides a bearing connection between the hinge plate 34 and the pivot member 36 thereby substantially eliminating wear on the inner diameter of the elongated passage 66 so as to inhibit sagging movements of the doors 20, 22 mounted by the hinge assemblies 30. Additionally, and since the bearing structure 70 is non-rotatably mounted to the hinge plate 34, there is no relative movement therebetween. Accordingly, the detrimental effects contaminants naturally have between the bearing structure 70 and the hinge plate 34 are eliminated.

The cap portions 78 at opposed ends of the bearing structure 70 also yield advantageous results during operation of the hinge assemblies 30. First, the non-metallic bearing surfaces 80 provided by the cap portions 78 engage and ride on the metallic supports 42, 44 of the hinge butt 32 thereby promoting rotational turning movements therebetween. Second, and because the caps 78 are locked to the bearings 72, 74 of the bearing structure 70 and rotate with the hinge plate 34, the natural wear normally persistent between washers and the aluminum hinge plate 34 are eliminated. Moreover, and since the cap portions 78 extend beyond the passage 66, they serve to protect the hinge portion 54 of the hinge plate 34 against wear relative to the hinge butt 32.

In a preferred form of the invention, the bearings structure 70 is snugly accommodated within the hinge portion 54 of the hinge plate 34. Although snugly accommodated within the passage so as to inhibit the bearing structure 70 from inadvertently separating from the hinge plate 34, and with the cap portions 78 of the bearing structure 70 extending axially beyond the hinge plate 34, the bearing structure 70 is easily and readily replaceable when required. As will be appreciated by those skilled in the art, such a design advantageously benefits assembly of the hinge structure 30.

Because the bearings 72, 74 of the bearing structure 70 can be preassembled to the hinge plate 34 in the elongated passage 66 defined by the hinge portion 54 of the hinge plate 34, inserting the pivot member 36 to attach the hinge plate 34 to the hinge butt 32 is facilitated. The present invention lessens alignment problems when inserting the pivot member 36 through the hinge butt 32 and hinge plate 34. That is, with the present invention, only the hole or aperture 46 in the upper projection or support 42 of hinge butt 32, along with the bore 80 in the bearing structure 70 and the hole or opening 46 in the lower projection or support 44 of the hinge butt need to be aligned relative to each other—rather than aligning five separate holes as compared to when washers are utilized in combination with a conventional hinge plate. Moreover, because the bearing structure 70 is preassembled to the hinge plate 34, there are only three parts to assemble when the hinge structure 30 is mounted to the trailer body 12. They are, the hinge butt 32, the hinge plate 34 with bearing structure 70 assembled therewithin, and the pivot pin 36. Thus, the present invention greatly facilitates assembly of the hinge structures 30 to the trailer body 12 in a cost efficient and effective manner.

From the foregoing it will be observed that numerous modifications and variations can be effected without departing or detracting from the true spirit and the novel concept of the present invention. It will be appreciated that the present disclosure is intended to set forth exemplifications of the invention which are not intended to limit the invention to the specific embodiments illustrated. The disclosure is intended to cover by the appended claims all such modifications and variations as fall within the spirit and scope of the claims.

What is claimed is:

1. A hinge assembly for connecting a door to a trailer body in a manner permitting pivotal movements of the door about a generally vertical axis, said hinge assembly comprising:

a longitudinally elongated hinge body having a mounting portion and a hinge portion, said mounting portion of the hinge body having a series of apertures for allowing attachment members to pass endwise therethrough, and with said hinge portion defining an elongated opening arranged toward one end of said hinge body, and wherein said hinge portion of the hinge body further defines a generally linear keyway as part of said elongated opening; and a pair of axially aligned bearings for journaling lengthwise portions of a pivot member defining the vertical axis about which said door pivots, each bearing including a barrel portion non-rotatably arranged within the elongated opening of said hinge body and a cap portion for limiting axial insertion of the bearing into the elongated opening of said hinge body, and wherein each bearing has, as part thereof, a key having a curved configuration between opposed ends thereof, with the curved key of each bearing being accommodated within the generally linear keyway defined by the hinge portion of the hinge body to prevent inadvertent endwise and rotational movements of the bearing relative to said hinge body.

2. The hinge assembly according to claim 1 wherein said elongated hinge body is formed from aluminum.

3. The hinge assembly according to claim 1 wherein said hinge portion and said mounting portion of said elongated hinge body are offset in generally parallel planes and are joined to each other by a neck portion.

4. A hinge assembly for connecting a door to a trailer body in a manner permitting pivotal movements of the door about a generally vertical axis, said hinge assembly comprising:

a longitudinally elongated hinge body having a mounting portion and a hinge portion, said mounting portion of the hinge body having a series of apertures for allowing attachment members to pass endwise therethrough, and with said hinge portion defining an elongated opening arranged toward one end of said hinge body, and wherein said hinge portion of the hinge body further defines a keyway as part of said elongated opening; and a pair of axially aligned bearings for journaling lengthwise portions of a pivot member defining the vertical axis about which said door pivots, each bearing including a barrel portion non-rotatably arranged within the elongated opening of said hinge body and a cap portion for limiting axial insertion of the bearing into the elongated opening of said hinge body, with each bearing having, as part thereof, a key, and wherein the key of each bearing has a flanged configuration extending in opposed directions relative to each other such that when the key is accommodated within the keyway the key and keyway combine with each other to inhibit inadvertent endwise and rotational movements of said bearing relative to said hinge body.

5. A hinge assembly, comprising:

a hinge plate having a mounting portion and a hinge portion, said mounting portion of said hinge plate being configured to permit attachment to a door or the like, and wherein the hinge portion of said hinge plate defines an elongated opening open at opposite ends thereof, and wherein said hinge portion of the hinge plate further defines a generally linear keyway as part of said elongated opening; and bearing structure non-rotatably accommodated within said opening for forming a bearing connection between said hinge plate and a pivot member endwise extending through the hinge portion of said hinge plate, said bearing structure including a cap formed integral therewith and extending from opposite ends of said opening, and wherein said bearing structure has, as part thereof, a key having a curved configuration between opposed ends thereof, with the curved key of the bearing structure being snugly accommodated within the generally linear configured keyway defined by the hinge portion of the hinge plate to prevent inadvertent shifting and rotational movements of the bearing relative to said hinge body.

6. The hinge assembly according to claim 5 wherein said hinge plate is formed from aluminum.

7. The hinge assembly according to claim 5 wherein said bearing structure includes a pair of bearings inserted into said passage from opposite ends thereof, and wherein said cap limits insertion of each bearing into the passage defined by the hinge portion of the hinge plate.

8. The hinge assembly according to claim 5 wherein said key is formed as an integral part of each bearing.

9. The hinge assembly according to claim 5 wherein said bearing structure is formed from an elastomeric material.

10. A hinge assembly, comprising:

a hinge plate having a mounting portion and a hinge portion, said mounting portion of said hinge plate being configured to permit attachment to a door or the like, and wherein the hinge portion of said hinge plate defines an elongated opening open at opposite ends thereof, and wherein said hinge portion of the hinge plate further defines a generally linear keyway as part of said elongated opening; and bearing structure non-rotatably accommodated within said opening for forming a bearing connection between said hinge plate and a pivot member endwise extending through the hinge portion of said hinge plate, said bearing structure including a cap formed integral therewith and extending from opposite ends of said opening, with said bearing structure having, as part thereof, a key, and wherein the key of the bearing structure has a flanged configuration extending in opposed directions relative to each other such that when the key is accommodated within the keyway the key and keyway combine with each other to inhibit inadvertent shifting and rotational movements of said bearing relative to said hinge plate.

11. The hinge assembly according to claim 10 wherein the key is formed as an integral part of each bearing.

12. A hinge assembly, comprising:

a hinge plate having a mounting portion and a hinge portion arranged in offset relation relative to each other, said mounting portion being configured to permit attachment to a door or the like, and with said hinge portion defining an elongated passage extending generally normal to the mounting portion and opening at opposite ends thereof, and wherein said hinge portion of the hinge plate further defines a generally linear keyway as part of said elongated opening; and a pair of non-metallic bearings non-rotatably inserted from opposite ends within the elongated passage defined the hinge portion of said hinge plate for forming a bearing connection between the hinge plate and a pivot member sized to pass endwise through the bearings, each bearing including cap structure for limiting axial insertion of the bearing into the elongated passage defined by said hinge plate, and wherein each bearing has, as part thereof, a key having a curved configuration between opposed ends thereof, with the curved key of each bearing being snugly accommodated within the generally linear keyway defined by the hinge portion of the hinge plate to prevent inadvertent shifting and rotational movements of the bearing relative to said hinge plate.

13. The hinge assembly according to claim 12 wherein said hinge plate is formed from aluminum.

14. The hinge assembly according to claim 12 wherein each one-piece bearing is formed from an elastomeric material to enhance the wearability of the bearing.

15. The hinge assembly according to claim 12 wherein said key is formed as an integral part of each bearing.

16. A hinge assembly, comprising:

a hinge plate having a mounting portion and a hinge portion arranged in offset relation relative to each other, said mounting portion being configured to permit attachment to a door or the like, and with said hinge portion defining an elongated passage extending generally normal to the mounting portion and opening at opposite ends thereof, and wherein said hinge portion of the hinge plate further defines a keyway as part of said elongated opening; and a pair of non-metallic bearings non-rotatably inserted from opposite ends within the elongated passage defined the hinge portion of said hinge plate for forming a bearing connection between the hinge plate and a pivot member sized to pass endwise through the bearings, each bearing including cap structure for limiting axial insertion of the bearing into the elongated passage defined by said hinge plate, and with each bearing having, as part thereof, a key, and wherein the key of each bearing has a flanged configuration extending in opposed directions relative to each other such that when the key is accommodated within the keyway the key and keyway combine with each other to inhibit inadvertent shifting and rotational movements of said bearing relative to said hinge plate.

17. The hinge assembly according to claim 16 wherein the key is formed as an integral part of each bearing.

18. A hinge assembly comprising:

a hinge plate having a mounting portion and a hinge portion, said mounting portion being configured to permit attachment of said hinge plate to a door, with said hinge portion having an elongated opening open at opposite ends thereof, and wherein said hinge portion defines opposed and spaced ends arranged to confront and fit between projections of a hinge butt, and with said hinge portion further defining a generally linear keyway open at opposite ends and formed as part of said elongated opening; and bearing structure accommodated within the elongated opening of the hinge portion of said hinge plate for forming a bearing connection between said hinge plate and a pivot member endwise extending through the bearing structure to pivotally connect the hinge plate to the hinge butt, said bearing structure including a cap formed integral therewith and extending from opposite ends of said elongated opening defined by the hinge portion of the hinge plate, and wherein said bearing structure has, as part thereof, an elongated key having a curved configuration between opposed ends thereof, with the curved key of the bearing structure being accommodated within the generally linear keyway defined by the hinge portion of the hinge plate to prevent inadvertent shifting and rotational movements of the bearing relative to said hinge body.

19. The hinge assembly according to claim 18 wherein said hinge plate is formed from aluminum.

20. The hinge assembly according to claim 18 wherein said bearing structure includes bearings inserted into said elongated opening defined by the hinge portion of the hinge plate from opposite ends thereof, and wherein said cap limits insertion of the bearings into the hinge portion of the hinge plate.

21. The hinge assembly according to claim 20 wherein said bearings of said bearing structure are identical to each other.

22. The hinge assembly according to claim 20 wherein each bearing of said bearing structure is formed from an elastomeric material.

23. The hinge assembly according to claim 18 wherein said bearing structure is non-rotatably mounted within the elongated opening defined by the hinge portion of the hinge plate.

24. The hinge assembly according to claim 18 wherein said bearing structure includes bearings inserted into opposite ends of said elongated opening, with each bearing having formed as part thereof a lengthwise portion of said key which is slidably accommodated with said keyway defined by said hinge plate.

25. A hinge assembly, comprising:

a hinge plate having a mounting portion and a hinge portion, said mounting portion being configured to permit attachment of said hinge plate to a door, with said hinge portion having an elongated opening open at opposite ends thereof, and wherein said hinge portion defines opposed and spaced ends arranged to confront and fit between projections of a hinge butt, and with said hinge portion further defining a generally linear keyway open at opposite ends and formed as part of said elongated opening; and bearing structure accommodated within said opening for forming a bearing connection between said hinge plate and a pivot member endwise extending through the hinge portion of said hinge plate, said bearing structure including a cap formed integral therewith and extending from opposite ends of said opening, with said bearing structure having a key as part thereof, and with the key of the bearing structure having a flanged configuration extending in opposed directions relative to each other such that when the key is accommodated within the keyway the key and keyway combine with each other to inhibit inadvertent shifting and rotational movements of said bearing relative to said hinge plate.

* * * * *